United States Patent [19]

Reichert, Jr. et al.

[11] Patent Number: 4,574,752

[45] Date of Patent: Mar. 11, 1986

[54] INTERNAL COMBUSTION ENGINE SHUTDOWN DEVICE

[75] Inventors: Marvion E. Reichert, Jr., P.O. Box 391, Elm Creek, Nebr. 68836; William D. Simmerman, Elm Creek, Nebr.

[73] Assignee: Marvion E. Reichert, Jr., Elm Creek, Nebr.

[21] Appl. No.: 660,703

[22] Filed: Oct. 15, 1984

[51] Int. Cl.[4] ..... F02B 77/08

[52] U.S. Cl. ..... 123/198 DB; 123/397

[58] Field of Search ..... 123/198 D, 198 DB, 351, 123/397

[56] References Cited

U.S. PATENT DOCUMENTS

| | | | |
|---|---|---|---|
| 3,680,539 | 8/1972 | Savage et al. | 123/198 DB |
| 4,088,110 | 5/1978 | Sperline | 123/198 DB |
| 4,371,050 | 2/1983 | Ikeura | 123/198 DB |
| 4,509,480 | 4/1985 | Kull et al. | 123/198 DB |

*Primary Examiner*—Ira S. Lazarus

*Attorney, Agent, or Firm*—William D. West

[57] ABSTRACT

An internal combustion engine shutdown device is disclosed. The device stops an engine running at high speed in a controlled fashion when a condition arises in a peripheral device or apparatus being driven or operated by the engine. The device provides a relay, a fuel shutoff control, an engine throttle control, and a timer. Upon the receipt of an external signal such as the de-energizing of a conventional "kill switch", the device immediately reduces engine speed to idle by the throttle control and delays the stopping of the engine by the timer until a pre-set time period has passed. Once the time period has elapsed so that the engine is in the proper state to be stopped, the fuel to the engine is cut off by the fuel shutoff control. The device is particularly adapted to the operation of an internal combustion engine used in a center pivot irrigation system.

12 Claims, 3 Drawing Figures

INTERNAL COMBUSTION ENGINE SHUTDOWN DEVICE

BACKGROUND OF THE INVENTION

1. Field of the Invention

The invention relates to an internal combustion engine shutdown device, and in particular to a device for a sequential controlled stopping of such an engine used to power a center pivot irrigation pump.

2. Discussion of the Technical Problems

Internal combustion engines including diesel and gasoline fueled engines are often used as a source of stationary power in applications where the operation of the engine is controlled by automatic devices instead of by human operators. One such application is in a center pivot irrigation system in which the engine is used to provide power to run the pump.

As conditions change which effect the continued safe operation of such a system, the engine must be stopped until the condition is remedied. A missalignment in a center pivot is one example of a condition which would necessitate an engine shutdown. Since the operator is not available to stop the engine, the shutdown must be accomplished automatically.

The ordinary device for automatically stopping an engine used to provide power to a pump in a center pivot irrigation system is a conventional "kill switch" which is is a switch directly sensitive to misalignment or some other unsafe condition. When the kill switch is activated by the unsafe condition, it shuts off the engine by shutting off the ignition or stopping the fuel from reaching the engine. The use of such a directly connected kill switch to stop an engine is well known in the art.

A kill switch can also be used in an indirect method of stopping an engine. One example of an indirect method is the use of a normally energized kill switch (energized while operating) which is de-energized in the event that pump pressure falls below a certain set point. Such an irrigation system is also fitted with a mechanical dump valve which opens in the event of a misalignment, thereby decreasing pump pressure and de-energizing the kill switch. As in the direct system, once the kill switch is de-energized the engine is immediately stopped.

Many stationary installations of internal combustion engines set the operating speed of the engine at a very high rate in order to achieve the best efficiency and power level. While operating within these high power settings the engines develop high internal temperatures. Unfortunately, the stopping of an engine abruptly at such a high power setting can damage the engine and reduce engine life. On the other hand, a reduction to idle speed followed by a time period for the engine to stabilize at the lower power setting would tend to prolong engine life and minimize engine wear.

In many applications, such as in a center pivot irrigation system, the system is protected from losing the water prime by having a check valve installed in the irrigation supply line. If the engine is abruptly brought to a stop, the sudden pressure surge against the check valve could cause damage to the valve or to the pump itself. By reducing engine speed to idle for a period of time, the pressure is reduced in stages without a potentially damaging surge.

Prior art "kill switch" engine stopping devices do not allow the engine speed to be reduced for a period of time to avoid excessive wear to the engine or other damage to the pump and/or the supply line. The engine is abruptly stopped by cutting off the fuel to the engine or by switching off the ignition system by the kill switch. Diesel and gasoline engines are normally stopped by closing off the fuel supply while natural gas and propane fueled engines are normally stopped by cutting off the ignition.

Examples of a number of prior art engine shut-down devices can be found in representative patents. Generally, the prior art relates to devices adapted to engines used in motor vehicles which must be shutoff due to a collision or some other emergency situation particular to motor vehicles. Very few devices relate to stationary engine applications and none known are directed to providing a controlled timed shutdown in order to reduce engine wear or system damage in the event of a problem in an external apparatus being powered by the engine.

U.S. Pat. No. 3,550,717 to Doty discloses a device that closes the fuel line in a moving engine in the event of a collision or theft. The invention brings about an immediate stopping of the engine rather than a reduction to idle speed first.

U.S. Pat. No. 3,371,667 to MacMillan disclosed a fail safe throttle control system for a vehicle in which the engine speed is reduced to idle in the event the accelerator is jammed. The invention provides for continued operation of the engine at a reduced speed rather than a timed shutdown.

U.S. Pat. No. 3,888,219 to Rogerson discloses an overspeed protection device for limiting the speed of a motor vehicle engine. The invention relates to the throttle linkage and is not responsive to an external condition.

U.S. Pat. No. 4,102,316 to Valbert relates to a hydromechanical shutoff for an internal combustion engine. The invention is actuated in response to internal conditions of the engine such as low oil pressure or high temperature and is not responsive to external conditions.

U.S. Pat. No. 4,106,469 to Dey discloses an automatic motor kill system in the event the air cleaning system becomes clogged. The invention is responsive to the internal condition of reduced manifold pressure.

U.S. Pat. No. 4,193,385 to Katsumata et al. discloses an engine stopping device for magneto ignition engines which such as lawnmowers which insures that the engine does not restart while it is in the process of stopping. The invention provides a device for stopping the engine by means of the ignition rather than by only shutting off the fuel.

U.S. Pat. No. 4,237,997 to Swanson discloses a switch and throttle lever combination to limit an overspeed condition in a snowmobile engine. The invention is not responsive to external conditions.

U.S. Pat. No. 4,333,827 to Cummins, II discloses an automatic shutdown device that is responsive to a reduced pressure of a pump inlet. The invention provides for an immediate engine stopping to prevent damage to the pump. Since the situation is an emergency, the engine must be stopped immediately. The device, while stopping the engine in response to reduced pressure does not provide for a time for the engine to operate at idle before the complete engine shutoff occurs.

As can be seen from the foregoing discussion, an inexpensive device is needed that will provide an automatic controlled shut down for a stationary engine in order to allow the engine operating parameters as well as pump system pressure to stabilize at a reduced level for an adjustable period of time before the engine is stopped. The device must be responsive to external conditions of both the direct and indirect type. It must be reliable and capable of being easily tested. The device should provide an adjustable idle operation time which can be set for the particular engine and equipment being powered by it. The device should be uncomplicated in design, easily installed on existing engines of numerous types, easily repaired, not subject to damage by vibration, and simple to manufacture. The instant invention is directed to all of these needs as well as to others as explained in the following summary.

SUMMARY OF THE INVENTION

It is a feature of the invention to provide an internal combustion engine shutdown device.

It is another feature of the instant invention to provide an inexpensive device useful in the controlled stopping of an engine to prolong the life of the engine.

It is another feature of the instant invention to provide an inexpensive device useful in the controlled stopping of an engine to prolong the life of the external equipment powered by the engine.

It is another feature of the instant invention to provide an internal combustion engine shutdown device which is sensitive to a condition external to the condition of the engine.

It is another feature of the instant invention to provide an internal combustion engine shutdown device which will allow the operating parameters of the engine to stabilize at a reduced engine speed before the engine is completely stopped.

It is yet another feature of the instant invention to provide an internal combustion engine shutdown device to be used with a stationary engine.

It is yet another feature of the instant invention to provide an internal combustion engine shutdown device to be used with a stationary engine powering a pump.

It is a still further object of the invention to provide an internal combustion engine shutdown device to be used in a center pivot irrigation system.

It is a still further object of the invention to provide an internal combustion engine shutdown device to be used in a center pivot irrigation system which will allow the system pressures to be gradually reduced by operating the engine at a reduced engine speed before the engine is completely stopped.

It is a still further object of the invention to provide an internal combustion engine shutdown device to be used in a center pivot irrigation system employing a conventional kill switch.

These and other features and objects are attained according to the instant invention by providing an internal combustion engine shutdown device having a relay, a fuel shutoff control, an engine throttle control, and an adjustable timer; in which the relay is connected to both the throttle control and the timer and the timer is connected to the fuel shutoff control. Upon the receipt of an external signal such as the de-energizing of a conventional "kill switch", the relay immediately reduces engine speed to idle by activating the throttle control. The adjustable timer is also started by the relay at the same time. Once a pre-set time period has elapsed putting the engine and or the external equipment in the proper state to be stopped, the timer activates the fuel shutoff control. The fuel shutoff control stops the fuel supply to the engine thereby bringing the engine to a stop from a low power setting.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
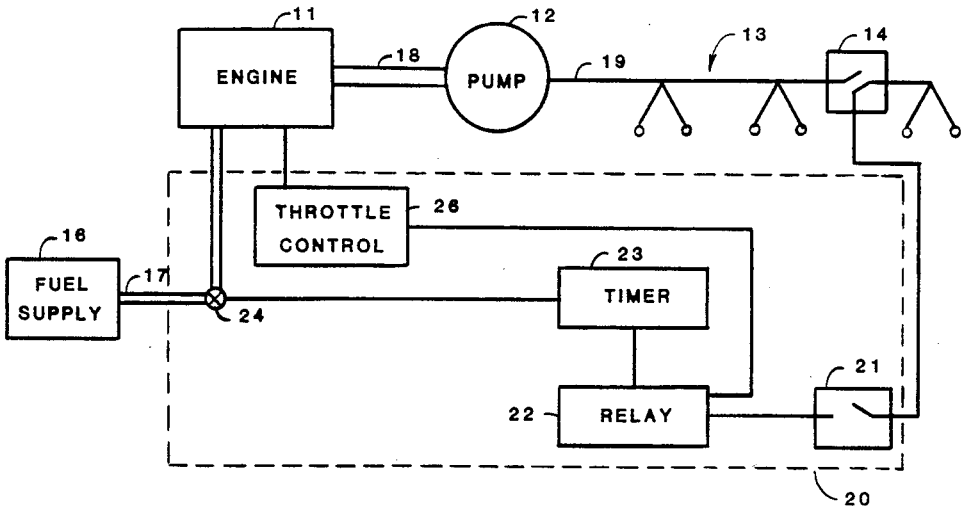
FIG. 1 is a schematic diagram of a center pivot irrigation system including an internal combustion engine shutdown device in accordance with the present invention.

The apparatus of the instant invention is depicted generally in FIG. 1. As can be seen by reference to FIG. 1, the invention is generally contained within the dashed lines 20 and includes a throttle control 26, a fuel shutoff valve 24, a timer 23, a relay 22, and test switch 21. The apparatus 20 is connected to an internal combustion engine 11 and an external safety kill switch 14.

For the purposes of understanding the device it has been shown in FIG. 1 attached to and in association with a center pivot irrigation system 13 which includes an engine 11 with a fuel supply 16, and a pivot irrigation pipe system 19 supported by a number of towers. The fuel supply 16 which is a tank or other supply of fuel is connected to the engine 11 by way of a fuel line 17 having a control or shutoff valve 24 in the line 17 by which the fuel can be shut off from the engine 11. The fuel shutoff valve 24 is of a type well known in the art and provides complete fuel shutoff with the activation of a solenoid or other type of fuel valve shutoff.

Figure 3:
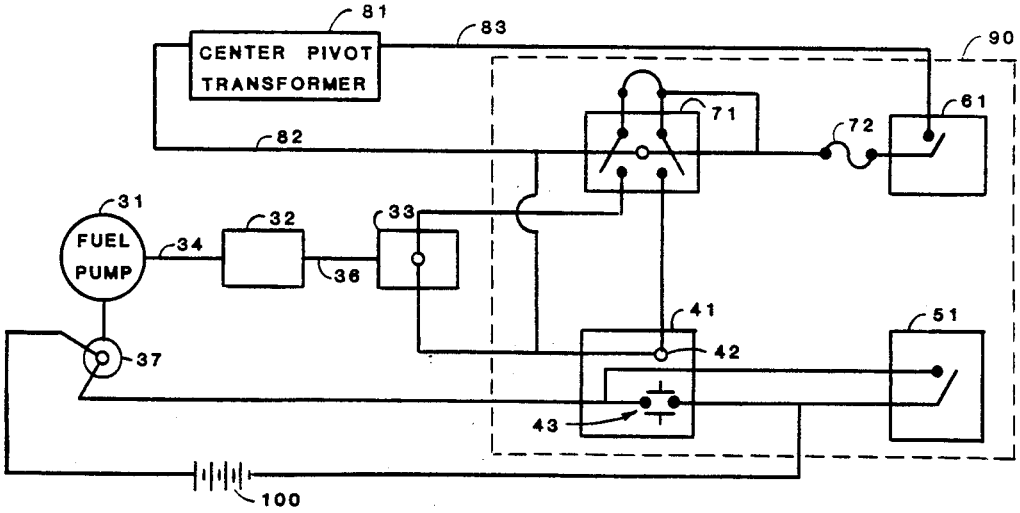
FIG. 3 is a schematic diagram of the electrical connections of a particular embodiment of the invention.

Continuing with reference to FIG. 1, it is to be noted that throttle control 26 is attached to engine 11 by a conventional method of a solenoid actuated rod attached to the carburetor throttle on gasoline powered engines and to the fuel pump on diesel powered engines. The throttle control 26 in either case is provided with an adjustable connecting link 32 as shown in FIG. 3 which allows the engine speed at idle to be adjusted for the particular conditions in the application employed. Timer 23 in FIG. 1 could be any delay timer such as a two position pneumatic timer, an R-C circuit or any mechanical or electrical timer.

Relay 22 could be any relay which upon receipt of a signal activates two succeeding functions. In the preferred embodiment depicted in FIG. 3 the relay 71 is an electrical double-pole contact magnetic switch relay. The relay is electrically connected between the external condition switch 14 (as shown in FIG. 1 but not shown in FIG. 3) and both the timer 23 and throttle control 26. A test switch 21 is provided to simulate the activation of external condition switch 14. Switch 14 is also known as a center "pivot safety switch". Test switch 21 is also known as a "system bypass switch" or "bypass switch". Test switch 21 is electrically connected between external condition switch 14 and relay 22.

Figure 2:
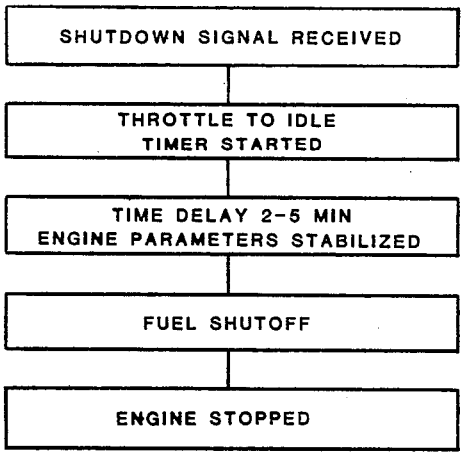
FIG. 2 is a diagrammatical representation of the sequence of events occurring in the shutdown of an internal combustion engine an accordance with the present invention.

The general operation of the device will now be described with reference to FIGS. 1 and 2. With engine 11 operating and having fuel supplied from fuel supply 16 by way of supply line 17 with valve 24 open, engine 11 drives pump 12 by way of power takeoff 18. Pump 12 provides system 13 with pressure. Test switch 21 is closed so that the misalignment switch 14 will trigger relay 22. When there is a misalignment or some unsafe external condition of the irrigation system 13, switch 14 activates relay 22 to activate the throttle control 26 and timer 23 simultaneously. Throttle control 26 set the throttle or engine speed to idle. Timer 23 counts down a pre-set time and then activates fuel shutoff valve 24. The sequence of events as depicted in FIG. 2 summarize the general operation of the device.

The preferred embodiment as shown in FIG. 3 conforms with the general depiction in FIG. 1 but includes the specific components used in conjunction with a diesel engine providing power in a center pivot irrigation system. Referring now to FIG. 3 it can be seen that in the preferred embodiment the throttle control 33 is an electrically operated solenoid driving a linkage rod 36 attached to an adjustable threaded connector 32 (which could be a simple turnbuckle) and fuel pump control rod 34. Since in the preferred embodiment power is provided by a diesel engine, the control of the engine speed is accomplished by control of the fuel pump 31. Throttle control 33 when activated pushes rod 34 by way of adjuster 32 and rod 36 to slow the speed of the engine. Electrically actuated fuel shutoff valve 37 is connected to engine battery 100 and timer 41. Fuel shutoff valve 37 is an ordinary fuel shutoff valve well known in the art. Battery 100 is normally a 12 or 24 volt lead/acid battery well known in the art and is part of the engine electrical system.

Some center pivot irrigation systems use electrical power and electrically driven pumps in which the stationary engine powers a generator which in turn provides electrical power to run the system including both the pump as well as the drive motors to move the system itself. Other systems use an engine driven pump and electric motors to move the tower mounted supply pipes over the ground. In this later type of system a source of high voltage electricity is available.

A misalignment switch 14 (not shown in FIG. 3) is part of a center-pivot system and is connected to the 110 volt electrical power supply from the center pivot transformer. That switch 14 (FIG. 1) is normally energized until a misalignment occurs at which time electrical power normally available from transformer 81 (FIG. 3) by way of circuit path 82 and 83 is ceased. Transformer electrical power holds a two pole magnetic contact 71 (relay) open but when the misalignment switch (not shown in FIG. 3) is triggered by a misalignment or tower stoppage or for whatever reason, circuit path 82 and 83 is opened. Relay 71 is then released. As can be seen in FIG. 3 an on/off test switch 61 is provided in circuit path 83 as well as fuse 72.

Since relay 71 is connected to both timer 41 and throttle control solenoid 33 which are electrically powered by the engine battery, both are immediately actuated. Throttle control 33 reduces engine speed to a pre-set adjustable setting. The turnbuckle adjustment 32 provides that pre-set engine speed. Timer 41 is also started. Timer 41 in the preferred embodiment is an off-delay pneumatic timer which can be adjusted for a delay period of from zero to five xinutes. Although 30 to 45 seconds of operation at idle is probably sufficient, in order to insure that the temperatures and pressures are stabilized it is contemplated that a time period of about two minutes is optimum for most applications. In any case the operator sets the adjustable timer 41 for whatever delay is appropriate. At the end of the pre-set delay period the timer 41 completes the fuel shutoff circuit, thus closing the fuel shutoff valve solenoid 37 which stops the engine.

As can be seen with reference to FIG. 3 a fuel shutoff bypass switch 51 is provided to bypass the timer and allow for the testing of the fuel shutoff valve 37 as well as the starting of the engine.

Additional test lights could be added to indicate if the solenoids 33 and 37 have been fully activated. In that case, the lights let the operator see whether or not the fuel is completely shutoff and whether the throttle has been completely reduced to the lowest adjusted setting. Those lights (not shown) would have simple contact switches which are activated by a complete travel of the solenoid. The timer 41, relay 71, switch 51, switch 61, fuse 72 and indicator lights (if any) are housed in a compact housing. It is contemplated that the circuit or portions of the circuit can be reduced to a printed circuit board or any other method known in the art.

The operation of the device will now be discussed with reference to FIGS. 1, 2, and 3 and in respect to the preferred embodiment. To start the system the test switch 61 is set to an off or open position. The timer bypass switch 51 is set to allow fuel valve 37 to remain open. The engine 11 is started and the manual throttle (not shown) on the engine is set at the operating RPM. Test switch 61 is set to an on or closed position and the timer bypass switch 51 is released. The throttle (not shown) is set to the desired idle position and the pump 12 is started. As the pivot system 13 operates correctly the engine 11 continues to run within its operating speed range. If there is a misalignment or if one or more of the pivot drive wheels become stuck, the pivot kill switch 14 (misalignment switch) de-energizes by releasing the relay 71 which makes contact with both the timer 41 and the throttle control 33. The throttle control 33 reduces the engine speed to idle and the timer 41 counts down a pre-set time until it actuates the fuel shutoff 37 thereby stopping the engine 11.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

We claim:

1. An internal combustion engine shutdown device for the controlled stopping of an internal combustion engine upon the receipt of a signal, the engine of the type having an ignition system, a fuel supply in fluid communication with the engine and an engine speed control; the device comprising:

a relay means for relaying the signal;

a timing means for determining a pre-set time period;

a throttle control means for controlling said engine speed control; and an engine stopping means for stopping the engine wherein said relay means is operably connected to said timing means and to said throttle control means and wherein said timing means is operably connected to said engine stopping means and wherein said throttle control means is operably connected to said engine speed control.

2. The engine shutdown device as described in claim 1 wherein said relay means comprises an electrical double-pole relay.

3. The engine shutdown device as described in claim 1 wherein said timing means comprises an off-delay pneumatic timer.

4. The engine shutdown device as described in claim 1 wherein said engine stopping means comprises an electrically operated valve in fluid communication between the fuel supply and the engine.

5. The engine shutdown device as described in claim 1 wherein said throttle control means comprises a solenoid.

6. The engine shutdown device as described in claim 5 wherein said throttle control means further comprises an adjustable rod operably connected between said solenoid and said engine speed control.

7. The engine shutdown device as described in claim 1 further comprising a test switch operably connected between said signal and said relay means.

8. The engine shutdown device as described in claim 7 further comprising a fuse operably connected between said test switch and said relay means.

9. The engine shutdown device as described in claim 8 further comprising a fuel shutoff bypass switch operably connected to said electrically operated fuel valve.

10. The engine shutdown device as described in claim 9 wherein said engine stopping means comprises an electrically operated fuel shutoff valve operably connected to said timing means.

11. The engine shutdown device as described in claim 9 wherein said engine stopping means comprises an electrically operated ignition shutoff switch operably connected between said engine ignition system and said timing means.

12. A method for the controlled stopping of an internal combustion engine upon the receipt of a signal, the engine of the type having a fuel supply in fluid communication with the engine and an engine speed control; the method comprising the steps of:

providing a relay means for relaying the signal;

a timing means for determining a pre-set time period; a throttle control means for controlling said engine speed control; and an engine stopping means for stopping the engine wherein said relay means is operably connected to said timing means and to said throttle control means and wherein said timing means is operably connected to said engine stopping means and wherein said throttle control means is operably connected to said engine speed control;

relaying the signal by the relay means to the timing means to start the timing means;

relaying the signal to the throttle control means to reduce the engine speed by slowing said engine speed control;

delaying a pre-set period of time by use of the timing means; and stopping the engine by activating said engine stopping means.

* * * * *